US011289789B1

(12) United States Patent
Bulcha

(10) Patent No.: US 11,289,789 B1
(45) Date of Patent: Mar. 29, 2022

(54) BANDPASS FILTER USING TRIANGULAR PATCH RESONATORS

(71) Applicant: United States of America as represented by the Administrator of NASA, Washington, DC (US)

(72) Inventor: Berhanu T. Bulcha, Bowie, MD (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 0 days.

(21) Appl. No.: 17/306,552

(22) Filed: May 3, 2021

Related U.S. Application Data

(60) Provisional application No. 63/049,194, filed on Jul. 8, 2020.

(51) Int. Cl.
*H01P 1/203* (2006.01)
*H01P 7/08* (2006.01)

(52) U.S. Cl.
CPC ..... *H01P 7/088* (2013.01); *H01P 1/203* (2013.01); *H01P 1/20309* (2013.01); *H01P 1/20381* (2013.01)

(58) Field of Classification Search
CPC .. H01P 1/203; H01P 1/20327; H01P 1/20336; H01P 1/20354; H01P 1/20363; H01P 1/20372; H01P 1/20381; H01P 1/2039; H01P 1/20309; H01P 7/08; H01P 7/082; H01P 7/084; H01P 7/086; H01P 7/088
USPC ..... 333/204, 205
See application file for complete search history.

(56) References Cited

U.S. PATENT DOCUMENTS 6,252,476 B1 * 6/2001 Maloratsky ..... H01P 1/20381 333/202
7,990,235 B1 * 8/2011 Yew ..... H01P 1/2039 333/204
2002/0190820 A1 * 12/2002 Fiedziuszko ..... H01P 7/082 333/205
2006/0082425 A1 * 4/2006 Jun ..... H01P 1/203 333/204
2007/0236311 A1 * 10/2007 Chen ..... H01P 1/2039 333/204
2009/0231063 A1 * 9/2009 Chen ..... H01P 1/2039 333/204
2016/0049929 A1 * 2/2016 Pippers ..... H01P 1/2039 327/382
2018/0102578 A1 * 4/2018 Huang ..... H05K 1/181

* cited by examiner

*Primary Examiner* — Stephen E. Jones
(74) *Attorney, Agent, or Firm* — Christopher O. Edwards; Bryan A. Geurts; Helen M. Galus

(57) ABSTRACT

A six-pole patch bandpass filter includes a dielectric substrate and six electrically-conductive isosceles-triangle patches disposed thereon. A first pair of the patches is an electrically connected pair. The first pair of patches is capacitively coupled to a first microstrip. A second pair of the patches is also an electrically connected pair. The second pair of patches is capacitively coupled to a second microstrip. A third pair of the patches are nested between and capacitively coupled to the first pair of patches and the second pair of patches.

11 Claims, 3 Drawing Sheets

BANDPASS FILTER USING TRIANGULAR PATCH RESONATORS

ORIGIN OF THE INVENTION

The invention described herein was made by an employee of the United States Government and may be manufactured and used by or for the Government of the United States of America for governmental purposes without the payment of any royalties thereon or therefor.

BACKGROUND OF THE INVENTION

1. Field of the Invention

This invention relates to bandpass filters. More specifically, the invention is a six-pole bandpass filter using triangular patch resonators.

2. Description of the Related Art

Single Side Band (SSB) receiver systems have an advantage over Double Side Band (DSB) receiver systems since SSB receiver designs include image rejection, frequency band selectivity, and better sensitivity. With respect to image rejection, an image signal in a DSB receiver system is produced due to the unused frequency band that is above or below the Local Oscillator (LO) which produces an equal Intermediate Frequency (IF) band as the desired frequency band. The two down-converted products co-add the noise in the IF channel and degrade the sensitivity of the instrument.

A graphic depiction useful in understanding the above-described image signal problem is presented in a receiver's frequency arrangement shown in FIG. 1. The frequency arrangement includes a Local Oscillator (LO) frequency ($f_{LO}$), an Upper Side Band (USB) as Radio Frequency ($f_{RF}$), and a Lower Side Band (LSB) image generating band. As is known in the art, a DSB receiver design contains both the LSB and USB, and it will convert to a similar IF band ("IFB") at $f_{IF}$ that is much lower in frequency for digital processing such as demodulation to uncover the RF information. In the down-conversion process, unnecessary spurious mixing products such as the image signal can be created. The image signal is defined as Image=$f_{RF}-2*(f_{IF})$.

To reject the image signal while also improving receiver selectivity, sensitivity, and spurious signals, a bandpass filter can be used. Due to the lack of filters above 300 GHz with sharp roll-off to suppress the image signal, most SSB receivers are implemented using a complex design implementing Band Separation (BS) or Image Rejection (IR) techniques that include 90-degree hybrid couplers and two mixers for down conversions. In addition, the size and cost associated with such designs make them less than desirable, especially for the rapidly growing communication industry that demands improved selectivity and proper utilization of the communication spectrum using compact, low-cost, and low insertion loss bandpass filters.

SUMMARY OF THE INVENTION

Accordingly, it is an object of the present invention to provide a bandpass filter.

Another object of the present invention is to provide a compact and low-cost bandpass filter for use in a single side-band receiver system that rejects an unwanted image signal.

Still another object of the present invention is to provide a scalable bandpass filter for use in a single side-band receiver system that can be tuned in frequency to reject an unwanted image signal.

Other objects and advantages of the present invention will become more obvious hereinafter in the specification and drawings.

In accordance with the present invention, a six-pole patch bandpass filter includes a dielectric substrate and six isosceles-triangle patches of an electrically-conductive material disposed on the substrate. A first pair of the patches has a first two of the patches electrically connected at a first position along opposing bases of the first two of the patches. The first pair of patches is capacitively coupled to a first microstrip. A second pair of the patches has a second two of the patches electrically connected at a second position along opposing bases of the second two of the patches. The second pair of patches is capacitively coupled to a second microstrip. A third pair of the patches are nested between and capacitively coupled to the first pair of patches and the second pair of patches.

BRIEF DESCRIPTION OF THE DRAWING(S)

Other objects, features and advantages of the present invention will become apparent upon reference to the following description of the preferred embodiments and the drawings, wherein corresponding reference characters indicate corresponding parts throughout the several views of the drawings and wherein.

DESCRIPTION OF THE PREFERRED EMBODIMENT(S)

Figure 1:
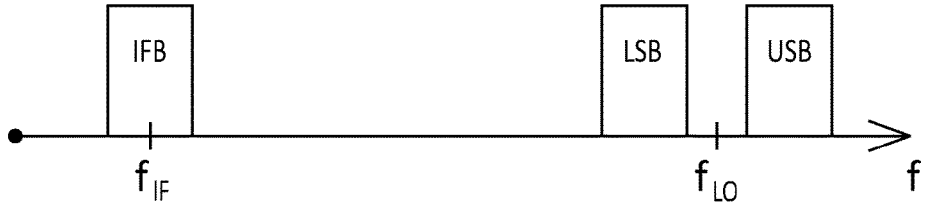
FIG. 1 is a graphic depiction of a conventional receiver frequency arrangement.
Figure 2:
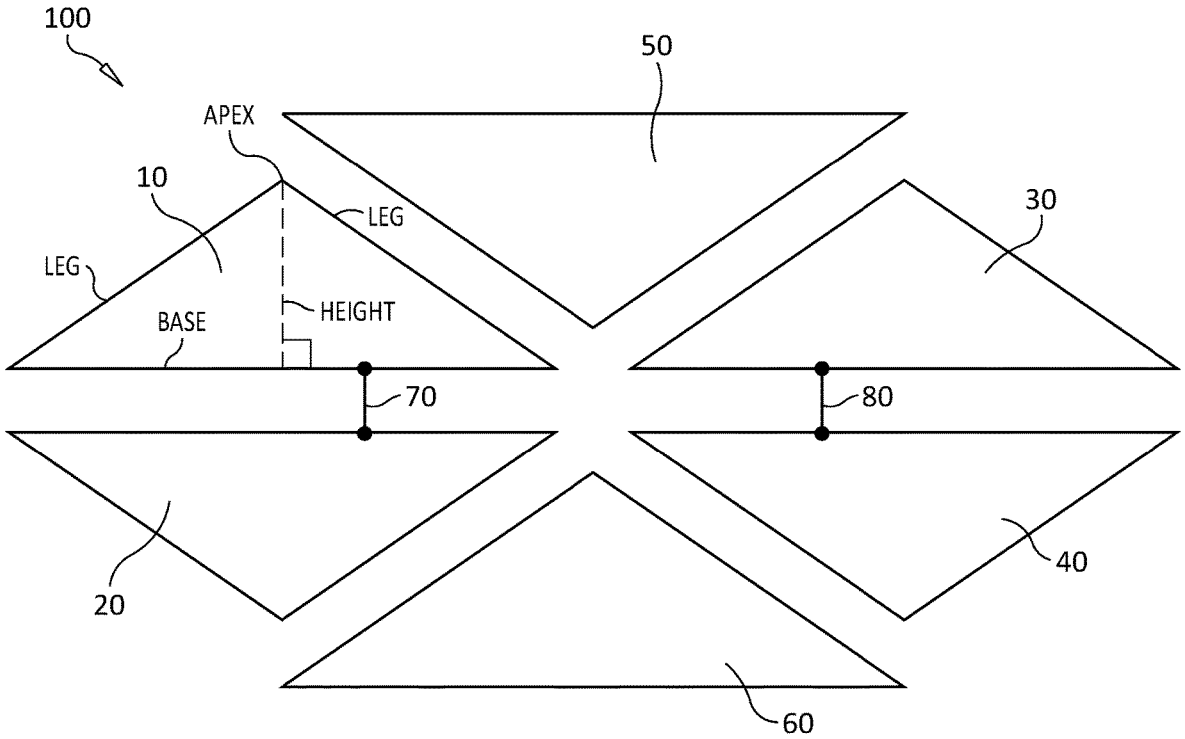
FIG. 2 is a schematic view of an arrangement of six isosceles-triangle patches for use in a bandpass filter in accordance with the present invention.

Referring again to the drawings and more particularly to FIG. 2, a schematic view is presented of a six isosceles triangle patch arrangement for use in a bandpass filter in accordance with the present invention. The arrangement of patches is referenced generally by numeral 100. The individual patches in arrangement 100 are indicated by reference numerals 10, 20, 30, 40, 50, and 60. As will be explained further below, each of the six patches 10-60 is made from an electrically-conductive material (e.g., gold) that is generally supported on a substrate (not shown in FIG. 2). Each of patches 10-60 can be identically sized.

As is well known in the art, an isosceles triangle has a base and two equal-length legs extending from the ends of the base to an apex. The height of an isosceles triangle is the distance along a normal line from the triangle's base to its apex. To maintain clarity in the illustration, these attributes of an isosceles triangle are only indicated for patch 10 whose base, legs, apex, and height are so-referenced in FIG. 2.

Patches 10-60 are arranged in three pairs. Briefly, patches 10 and 20 comprise a first pair of patches, patches 30 and 40 comprise a second pair of patches, and patches 50 and 60 comprise a third pair of patches disposed between and nested between the first pair and second pair of patches.

Patches 10 and 20 are arranged with their bases opposing and spaced-apart from one another. Patches 10 and 20 are electrically connected to one another at a portion of their opposing bases using a microstrip line 70. Similarly, patches 30 and 40 are arranged with their bases opposing and spaced-apart from one another. Patches 30 and 40 are electrically connected at a portion of their opposing bases using a microstrip line 80. Patches 50 and 60 are arranged with their apexes opposing one another with patch 50 nesting between patches 10 and 30, and with patch 60 nesting between patches 20 and 40. Patch 50 is electrically unconnected and is capacitively coupled to patches 10 and 30 at the opposing legs of the patches. Similarly, patch 60 is electrically unconnected and is capacitively coupled to patches 20 and 40 at the opposing legs of the patches.

Figure 3:
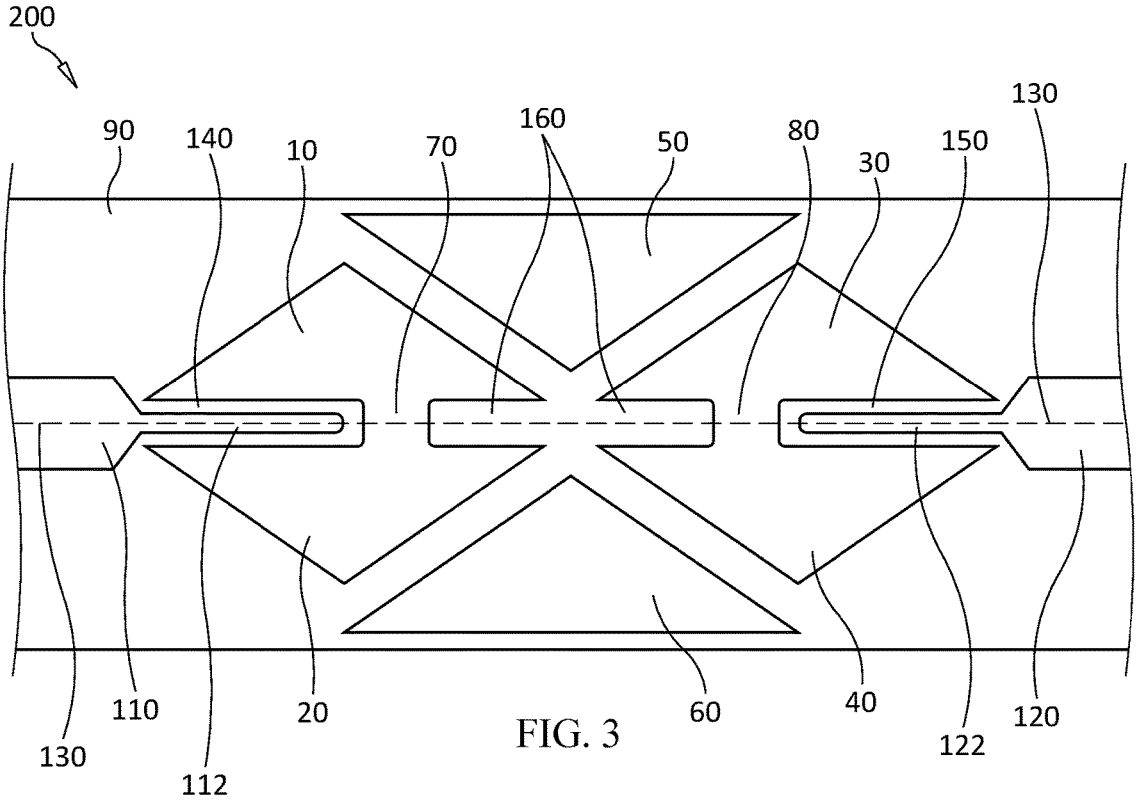
FIG. 3 is a plan view of a six-pole patch bandpass filter in accordance with an embodiment of the present invention.

Referring now to FIG. 3, a six-pole patch bandpass filter constructed in accordance with an embodiment of the present invention is shown and is referenced generally by numeral 200. Filter 200 employs the above-described six isosceles triangle patch arrangement such that filter 200 includes six electrically-conductive, isosceles-triangle patches 10-60 where each apex defines a pole of the filter. Patches 10-60 are disposed on a dielectric substrate 90. Suitable dielectric materials include quartz, gallium arsenide, alumina, Rogers materials, etc. Patches 10 and 30 are electrically connected by a first integral region of electrical connectivity 70, and patches 30 and 40 are electrically connected by a second integral region of electrical connectivity 80. The fabrication technique used to dispose patches 10-60 and regions 70/80 onto substrate 90 are not limitations of the present invention.

Microstrips are also disposed on substrate 90 for the purpose of supplying an input wave to filter 200 and to transmit an output wave from filter 200. A first microstrip 110 terminates in a taper line 112, and a second microstrip 120 terminates in a taper line 122. The microstrips to include their taper lines are disposed on substrate 90 such that they are aligned along a common axis referenced by dashed-line 130.

The above-described pairs of patches 10/20, 30/40, and 50/60 are arranged along common axis 130 such that patches 10 and 20 are mirror images of one another with respect to common axis 130, patches 30 and 40 are mirror images of one another with respect to common axis 130, and patches 50 and 60 are mirror images of one another with respect to common axis 130. The spacing or gap along common axis 130 between the bases of patches 10 and 20 (referenced by numeral 140) is the same as the gap (referenced by numeral 150) along common axis 130 between the bases of patches 30 and 40. Disposed within gap 140 is the taper line 112 of microstrip 110. Disposed within gap 150 is the taper line 122 of microstrip 120. Taper lines 112 and 122 are spaced apart from their respective patch bases and the corresponding regions of electrical connectivity (i.e., regions 70 and 80). As a result, microstrip 110 is capacitively coupled via its taper line 112 to the patch pair defined by patches 10 and 20. In a similar fashion, microstrip 120 is capacitively coupled via its taper line 122 to the patch pair defined by patches 30 and 40. In addition, a contiguous spacing or gap 160 along common axis 130 is defined between electrical connectivity regions 70 and 80 with gap 160 being partially disposed between the bases of patches 10/20 and partially disposed between the bases of patches 30/40.

Figure 4:
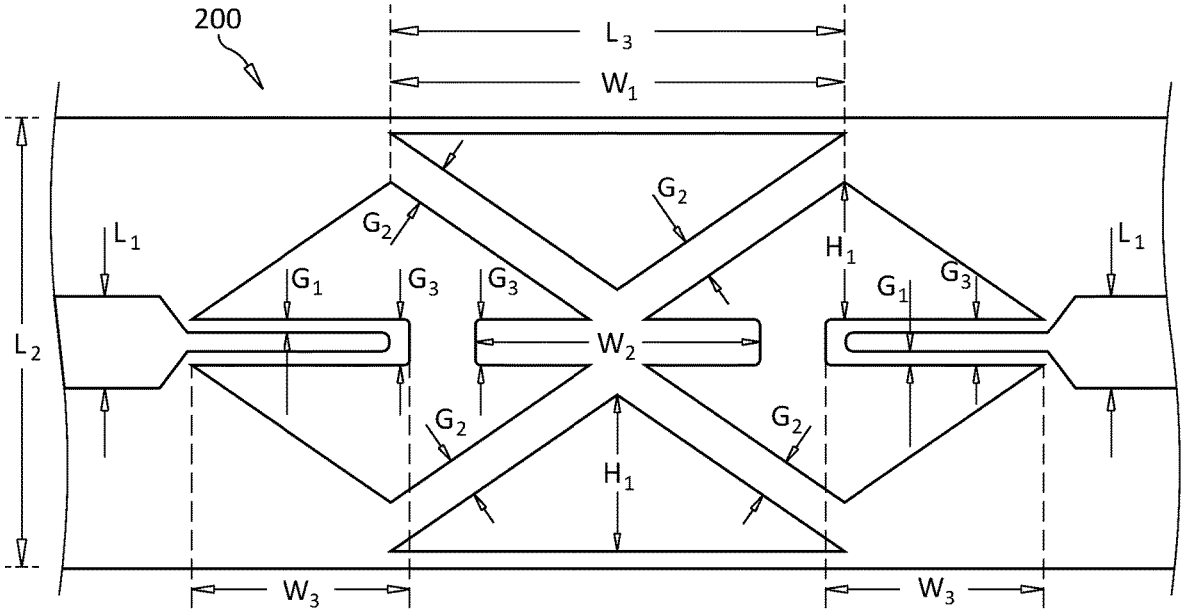
FIG. 4 is the plan view illustrated in FIG. 3 with the key dimensional parameters shown thereon.

Referring now to FIG. 4, the above-described structure of filter 200 is annotated with a number of dimension parameters used for scaling filter 200 for operational center frequencies ranging from 1-1000 GHz. For clarity of illustration, the reference numerals for the structural features of filter 200 presented in FIG. 3 have been omitted from FIG. 4. Accordingly, it is to be understood that the reference numerals used in the description of FIG. 4 refer to those used in the FIG. 3 presentation of filter 200.

Referring now simultaneously to FIGS. 3 and 4, the dimensional parameters used for scaling filter 200 are as follows:

- the width of substrate 90 is $L_2$,
- the width of microstrips 110 and 120 is $L_1$,
- the distance between apexes of patches 10 and 20 as well as between the apexes of patches 20 and 40 is $L_3$,
- the length of the base of each of patches 10-60 is $W_1$ which also equals $L_3$,
- the length of gap 160 is $W_3$,
- the length of each of gaps 140 and 150 is $W_3$,
- the height of each of patches 10-60 is $H_1$,
- the spacing between taper line 112 and each of the bases of patches 10 and 20 is $G_1$,
- the spacing between taper line 122 and each of the bases of patches 30 and 40 is also $G_1$,
- the spacing between the legs of adjacent ones patches 10-60 is $G_2$ and
- the width of gaps 140, 150, and 160 is $G_3$.

The following list of the above-referenced parameters includes a value for each parameter in (micrometers*GHz) where each value has been normalized for an operational center frequency of 1 GHz. That is, for any other operational center frequency between 1 GHz and 1000 GHz, each of the values is simply scaled or multiplied by the reciprocal of the factor used to increase the operational center frequency to obtain dimension values in micrometers. For example, each of the values is multiplied by ⅕ for an operational center frequency of 5 GHz, each of the values is multiplied by 1/500 for an operational center frequency of 500 GHz, etc.

$W_1$=114570 micrometers
$W_2$=79800 micrometers
$W_3$=56430 micrometers
$H_1$=25650 micrometers
$G_1$=3420 micrometers
$G_2$=7980 micrometers
$G_3$=9633 micrometers
$L_1$=17100 micrometers
$L_2$=81453 micrometers
$L_3$=114570 micrometers The above-described six-patch arrangement and microstrips can be built on a variety of substrate materials. Since the majority of commercially-available filters, amplifiers, attenuators, microwave equipment, etc., that could incorporate the bandpass filter of the present invention operate at 50 Ohm impedance, the input and output impedance of microstrips 110 and 120 will most often be 50 Ohms. The thickness $h_s$ of substrate 90 is determined in accordance with $$Z_0 = \frac{120\pi}{2\sqrt{2}\,\pi\sqrt{\varepsilon_{eff}+1}}\ln\left\{1+\frac{4h_s}{L_1}\left[\frac{14+8/\varepsilon_{eff}}{11}\frac{4h_s}{L_1}+\sqrt{\left(\frac{14+8/\varepsilon_{eff}}{11}\right)^2\left(\frac{4h_s}{L_1}\right)^2+\frac{1+1/\varepsilon_{eff}}{2}\pi^2}\right]\right\} \quad (\Omega)$$

where $Z_0$ is the 50 Ohm input and output impedance of microstrips 110 and 120. The value for $\varepsilon_{eff}$ is an effective dielectric constant of the selected substrate material. If a different input/output impedance value is needed, then the width of microstrips at 110 and 120 would require adjustment (i.e., widened for lower impedance and narrowed for higher impedance).

Figure 5:
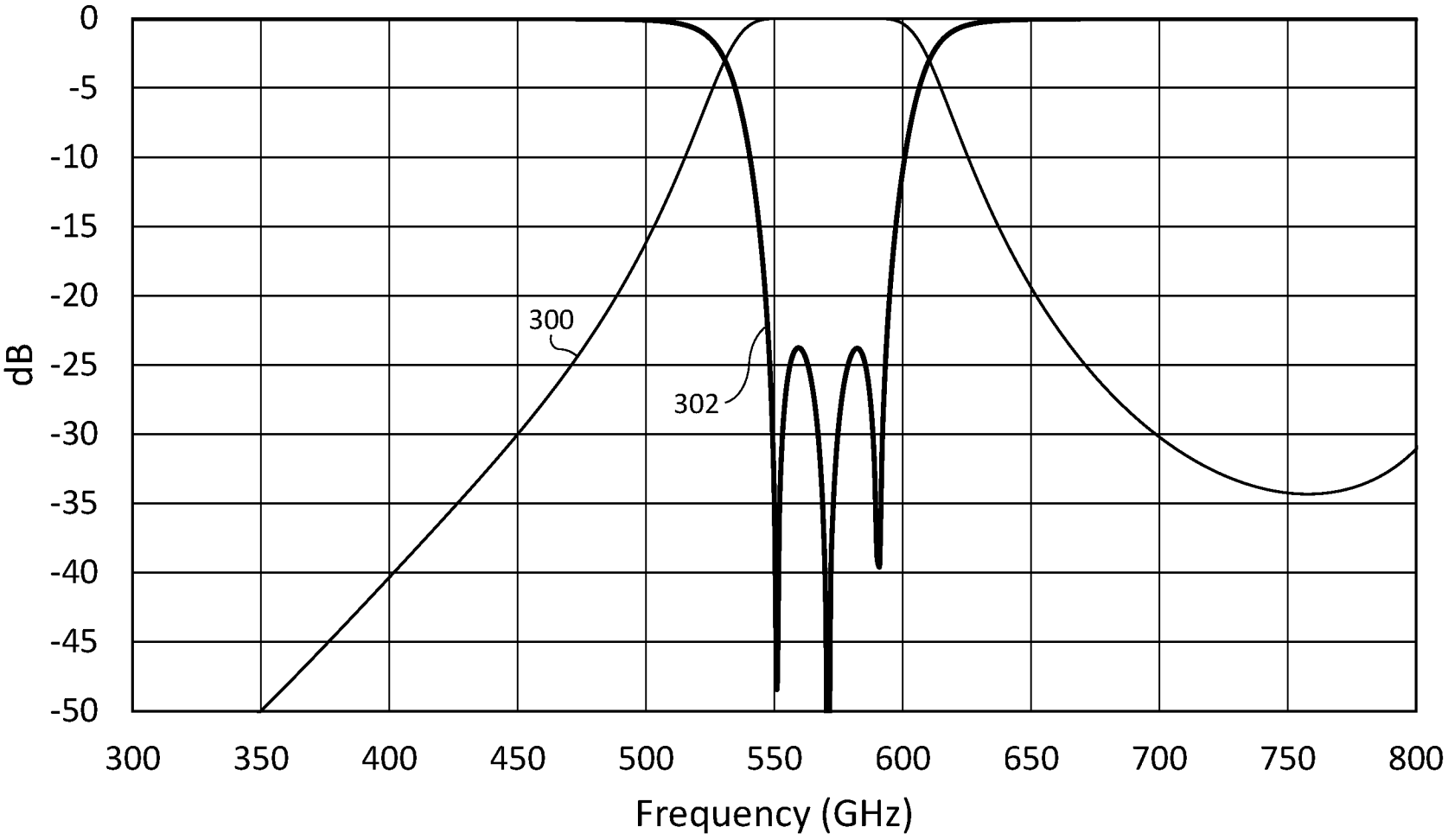
FIG. 5 is a filter performance graph for a six-pole patch bandpass filter constructed in accordance with the present invention for operation in the 530-610 GHz frequency band.

By way of example, a filter performance graph is shown in FIG. 5 for a six-pole patch bandpass filter that was constructed in accordance with the present invention for the center frequency ($F_0=(F_1+F_2)/2$) of 570 GHz, where $F_1=530$ GHz is the lower frequency and $F_2=610$ GHz is the upper frequency to define an operational bandwidth ($\Delta F=F_2-F_1$) of 80 GHz. The 530-610 GHz filter constructed as described herein provides a fractional bandwidth (BW) in percent (%) that can be calculated as: BW (%)$=\Delta F/F_0=14.03\%$. Curve 300 shows that the filter demonstrates a sharp roll-off with low loss in the transmission band of 530-610 GHz. Curve 300 illustrates signal transmission performance as the signal travels from microstrip 110 to microstrip 120. Curve 302 shows that the filter provides great outside band rejection of the unwanted signals (e.g., noise, spurious, and image signals) on either side of the passband as the signal is injected in either port via microstrip 110 or microstrip 120.

The advantages of the present invention are numerous. The patch bandpass filter is readily tuned/scaled to any operational center frequency in the 1-1000 GHz range. The filter's sharp roll-off performance features are provided in a simple and compact design for paring with heterodyne receivers requiring image signal rejection. In addition, the filter design can be used to limit the bandwidth of direct detection receivers to reduce noise bandwidth.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A six-pole patch bandpass filter, comprising:

a dielectric substrate; and six isosceles-triangle patches of an electrically-conductive material disposed on said substrate, wherein a first pair of said patches has a first two of said patches electrically connected at a first position along opposing bases of said first two of said patches, said first pair of said patches adapted to be capacitively coupled to a first microstrip;

wherein a second pair of said patches has a second two of said patches electrically connected at a second position along opposing bases of said second two of said patches, said second pair of said patches adapted to be capacitively coupled to a second microstrip, and wherein a third pair of said patches are nested between and capacitively coupled to said first pair of said patches and said second pair of said patches.

2. A six-pole patch bandpass filter as in claim 1, wherein the first microstrip and the second microstrip are adapted to be aligned along a common axis, and wherein said patches associated with each of said first pair, said second pair, and said third pair are arranged in a mirror image fashion with respect to the common axis.

3. A six-pole patch bandpass filter as in claim 1, wherein a first gap separates said opposing bases associated with said first pair of said patches except at said first position wherein the first microstrip is disposed in a portion of said first gap, and wherein a second gap separates said opposing bases associated with said second pair of said patches except at said second position wherein the second microstrip is disposed in a portion of said second gap.

4. A six-pole patch bandpass filter as in claim 1, wherein a contiguous gap region is between said first position and said second position, said contiguous gap region being partially disposed between said patches associated with said first pair and partially disposed between said patches associated with said second pair.

5. A six-pole patch bandpass filter as in claim 1, wherein the first microstrip and the second microstrip are adapted to be aligned along a common axis, wherein a first gap is aligned along said common axis and separates said opposing bases associated with said first pair of said patches, said first gap adapted to have the first microstrip disposed therein, wherein a second gap is aligned along said common axis and separates said opposing bases associated with said second pair of said patches, said second gap adapted to have the second microstrip disposed therein, wherein a third gap is aligned along said common axis between said first position and said second position, said third gap being partially disposed between said opposing bases associated with said first pair of said patches and partially disposed between said opposing bases associated with said second pair of said patches.

6. A six-pole patch bandpass filter as in claim 1, wherein said patches are identical in size.

7. A six-pole patch bandpass filter, comprising:

a dielectric substrate;

six electrically-conductive patches disposed on said substrate, each of said patches configured as an isosceles triangle having a base, legs, and an apex, wherein, for a first pair of said patches, said base of a first of said patches opposes and is spaced apart from said base of a second of said patches, wherein, for a second pair of said patches, said base of a third of said patches opposes and is spaced apart from said base of a fourth of said patches, wherein, for a third pair of said patches, said apex of a fifth of said patches opposes and is spaced apart from said apex of a sixth of said patches, wherein said fifth of said patches is nested between and is capacitively coupled to said first of said patches and said third of said patches, and wherein said sixth of said patches is nested between and is capacitively coupled to said second of said patches and said fourth of said patches;

a first electrical connection for electrically coupling a portion of said base of said first of said patches to a portion of said base of said second of said patches; and a second electrical connection for electrically coupling a portion of said base of said third of said patches to a portion of said base of said fourth of said patches.

8. A six-pole patch bandpass filter as in claim 7, wherein said patches are identical in size.

9. A six-pole patch bandpass filter as in claim 7, wherein said first pair of said patches, said second pair of said patches, and said third pair of said patches are arranged along a common axis, and wherein said first of said patches and said second of said patches are mirror images of one another with respect to said common axis, wherein said third of said patches and said fourth of said patches are mirror images of one another with respect to said common axis, and wherein said fifth of said patches and said sixth of said patches are mirror images of one another with respect to said common axis.

10. A six-pole patch bandpass filter tunable for operation in a frequency range of 1 to 1000 GHz, comprising:

a dielectric substrate having a width $L_2$;

a first microstrip of width $L_1$ disposed on said substrate, said first microstrip terminating in a first taper line;

a second microstrip of said width $L_1$ disposed on said substrate, said second microstrip terminating in a second taper line, wherein said first taper line and said second taper line are aligned with one another along a common axis;

six identically-sized, electrically-conductive patches disposed on said substrate, each of said patches configured as an isosceles triangle having a base of length $W_1$, a height $H_1$, and an apex, wherein, for a first pair of said patches, said base of a first of said patches opposes and is spaced apart from said base of a second of said patches by a distance $G_3$, wherein, for a second pair of said patches, said base of a third of said patches opposes and is spaced apart from said base of a fourth of said patches by said distance $G_3$, wherein, for a third pair of said patches, said apex of a fifth of said patches opposes and is spaced apart from said apex of a sixth of said patches, wherein said fifth of said patches is nested between and is spaced apart from each of said first of said patches and said third of said patches by a distance $G_2$, and wherein said sixth of said patches is nested between and is spaced apart from each of said second of said patches and said fourth of said patches by said distance $G_2$;

a first electrical connection for electrically coupling a portion of said base of said first of said patches to a portion of said base of said second of said patches to thereby define a first gap of length $W_3$ between said base of said first of said patches and said base of said second of said patches, wherein said first taper line is disposed within said first gap and is spaced from each of said base of said first of said patches and said base of said second of said patches by a distance $G_1$; and a second electrical connection for electrically coupling a portion of said base of said third of said patches to a portion of said base of said fourth of said patches to thereby define a second gap of said length $W_3$ between said base of said third of said patches and said base of said fourth of said patches, wherein said second taper line is disposed within said second gap and is spaced from each of said base of said third of said patches and said base of said fourth of said patches by said distance $G_1$, wherein said apex of said first of said patches is spaced apart from said apex of said third of said patches by a distance $L_3$, and wherein said apex of said second of said patches is spaced apart from said apex of said fourth of said patches by said distance $L_3$, wherein a contiguous gap region of length $W_2$ is between said first electrical connection and said second electrical connection, said contiguous gap region partially disposed between said patches associated with said first pair of said patches and partially disposed between said patches associated with said second pair of said patches, wherein, for a filter operational center frequency of 1 GHz, $W_1$ and $L_3$ are 114,570 micrometers, $W_2$ is 79,800 micrometers, $W_3$ is 56,430 micrometers, $H_1$ is 25,650 micrometers, $G_1$ is 3420 micrometers, $G_2$ is 7980 micrometers, $G_3$ is 9633 micrometers, $L_1$ is 17,100 micrometers, and $L_2$ is 81,453 micrometers, and wherein, when said operational center frequency is scaled by a multiplier having a value between 1 and 1000, values for $W_1$, $W_2$, $W_3$, $H_1$, $G_1$, $G_2$, $G_3$, $L_1$, $L_2$, and $L_3$ are scaled in accordance with a reciprocal of said multiplier.

11. A six-pole bandpass filter as in claim 10, wherein a thickness $h_s$ of said substrate is determined in accordance with $$Z_0 = \frac{120\pi}{2\sqrt{2}\,\pi\sqrt{\varepsilon_{eff}+1}}\ln\left\{1+\frac{4h_s}{L_1}\left[\frac{14+8/\varepsilon_{eff}}{11}\frac{4h_s}{L_1}+\sqrt{\left(\frac{14+8/\varepsilon_{eff}}{11}\right)^2\left(\frac{4h_s}{L_1}\right)^2+\frac{1+1/\varepsilon_{eff}}{2}\pi^2}\right]\right\} \quad (\Omega)$$

where $Z_0$ is an input impedance and an output impedance of each said first microstrip and said second microstrip set to 50 Ohms, and $\varepsilon_{eff}$ is a dielectric constant of said substrate.

* * * * *